US005758751A

United States Patent [19]

Charles

[11] Patent Number: 5,758,751

[45] Date of Patent: Jun. 2, 1998

[54] FOLDABLE SUITCASE

[76] Inventor: Shulamit Charles, 1198 E. 22nd St., Brooklyn, N.Y. 11210

[21] Appl. No.: 756,178

[22] Filed: Nov. 25, 1996

[51] Int. Cl.[6] ..... A45C 7/00

[52] U.S. Cl. ..... 190/107; 190/18 A; 190/114; 190/115; 220/7

[58] Field of Search ..... 190/18 A, 107, 190/114, 115; 220/4.28, 6, 7

[56] References Cited

U.S. PATENT DOCUMENTS

| | | | |
|---|---|---|---|
| 643,874 | 2/1900 | Jenkins . | |
| 736,871 | 8/1903 | O'Brien . | |
| 790,748 | 5/1905 | Rangnow | 190/18 A X |
| 1,040,300 | 9/1912 | Fitzgerald | 190/107 |
| 2,416,783 | 3/1947 | Vallieres | 190/107 |
| 2,555,718 | 6/1951 | Vineberg | 190/107 |
| 2,768,719 | 10/1956 | Samuel | 190/107 |
| 2,806,563 | 9/1957 | Einhorn | 190/107 |
| 3,861,703 | 1/1975 | Gould . | |
| 3,889,965 | 6/1975 | Zeitlin . | |
| 3,889,966 | 6/1975 | Zeitlin . | |
| 4,489,815 | 12/1984 | Martinez et al. | 190/107 X |
| 5,103,945 | 4/1992 | Kaneko . | |
| 5,332,093 | 7/1994 | Littlepage | 190/107 X |
| 5,515,987 | 5/1996 | Jacques et al. | 220/6 |

FOREIGN PATENT DOCUMENTS

| | | | |
|---|---|---|---|
| 2591872 | 6/1987 | France | 190/18 A |

*Primary Examiner*—Stephen Cronin

*Attorney, Agent, or Firm*—Goldstein & Associates

[57] ABSTRACT

A suitcase which is constructed of individual panels joined to each other by hinge mechanisms. The hinge mechanisms allow the panels to selectively form right angles so that the panels form a suitcase shell in the shape of a rectangular prism having a storage space, or selectively allow the panels to be folded against each other so that the suitcase may be stored flat. The suitcase has wheel assemblies, and straps which help hold the suitcase together, and hold the wheel assemblies against the suitcase shell.

10 Claims, 5 Drawing Sheets

FOLDABLE SUITCASE

BACKGROUND OF THE INVENTION

The invention relates to a foldable suitcase. More particularly, the invention relates to a suitcase which is stored flat, and then which is unfolded to form a suitcase capable of securely enclosing a significant storage space.

Often, in one's home, the amount of storage space is limited. Luggage, being so big and bulky by nature, takes up a lot of space when not in use. Furthermore, when one is traveling, having to leave a suitcase in a room will frequently take up much of the free space in the room, leaving a limited area to walk.

Moreover, in the course of one's travels, a person will accumulate many additional articles and souvenirs that do not fit in the luggage one has with him. It is inconvenient and cumbersome to have to carry many smaller, more fragile parcels, in addition to one's luggage. Especially when one is traveling by airplane or train, it is quite possible that one of these parcels will be misplaced or broken in the course of transporting it.

It is often impractical for a traveler to carry with him an additional piece of empty luggage for any additional articles that are acquired during the course of the trip. Furthermore, it can be quite expensive to purchase an additional piece of permanent luggage that may not even be needed in most circumstances.

U.S. Pat. No. 2,555,718 to Vineberg discloses a collapsible suitcase that can be carried in a traveler's luggage in case of the need for added space for articles accumulated during the trip. While this invention does allow a traveler to have an additional suitcase without sacrificing a lot of room, it does not provide the user with a secure piece capable of undergoing rough travel such as an airplane or train ride. Although it does allow for additional space, it is impractical for travel.

While these units may be suitable for the particular purpose employed, or for general use, they would not be as suitable for the purposes of the present invention as disclosed hereafter.

SUMMARY OF THE INVENTION

It is an object of the invention to produce a foldable suitcase.

It is another object of the invention to produce a foldable suitcase that can easily and quickly be collapsed to a compact size for easy handling, consuming little space while being stored at home or during one's travels.

It is a further object of the invention to produce a foldable suitcase that comprises reinforcing straps extending the entire length of the suitcase. These straps lend added support to the piece while eliminating the possibility of the suitcase opening by accident during transportation.

It is a still further object of the invention to produce a foldable suitcase having detachable wheels which may be attached to the bottom of said suitcase, as well as a handle on the top of the piece, for easy transport. Said wheels and handle allow a user to manage the piece with ease while still carrying one's permanent luggage.

It is a still further object of the invention to produce a foldable suitcase made of a durable and rigid material for withstanding rough travel while protecting one's possession inside the suitcase.

The invention is a suitcase which is constructed of individual panels joined to each other by hinge mechanisms. The hinge mechanisms allow the panels to selectively form right angles so that the panels form a suitcase shell in the shape of a rectangular prism having a storage space, or selectively allow the panels to be folded against each other so that the suitcase may be stored flat. The suitcase has wheel assemblies, and straps which help hold the suitcase together, and hold the wheel assemblies against the suitcase shell.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 8:
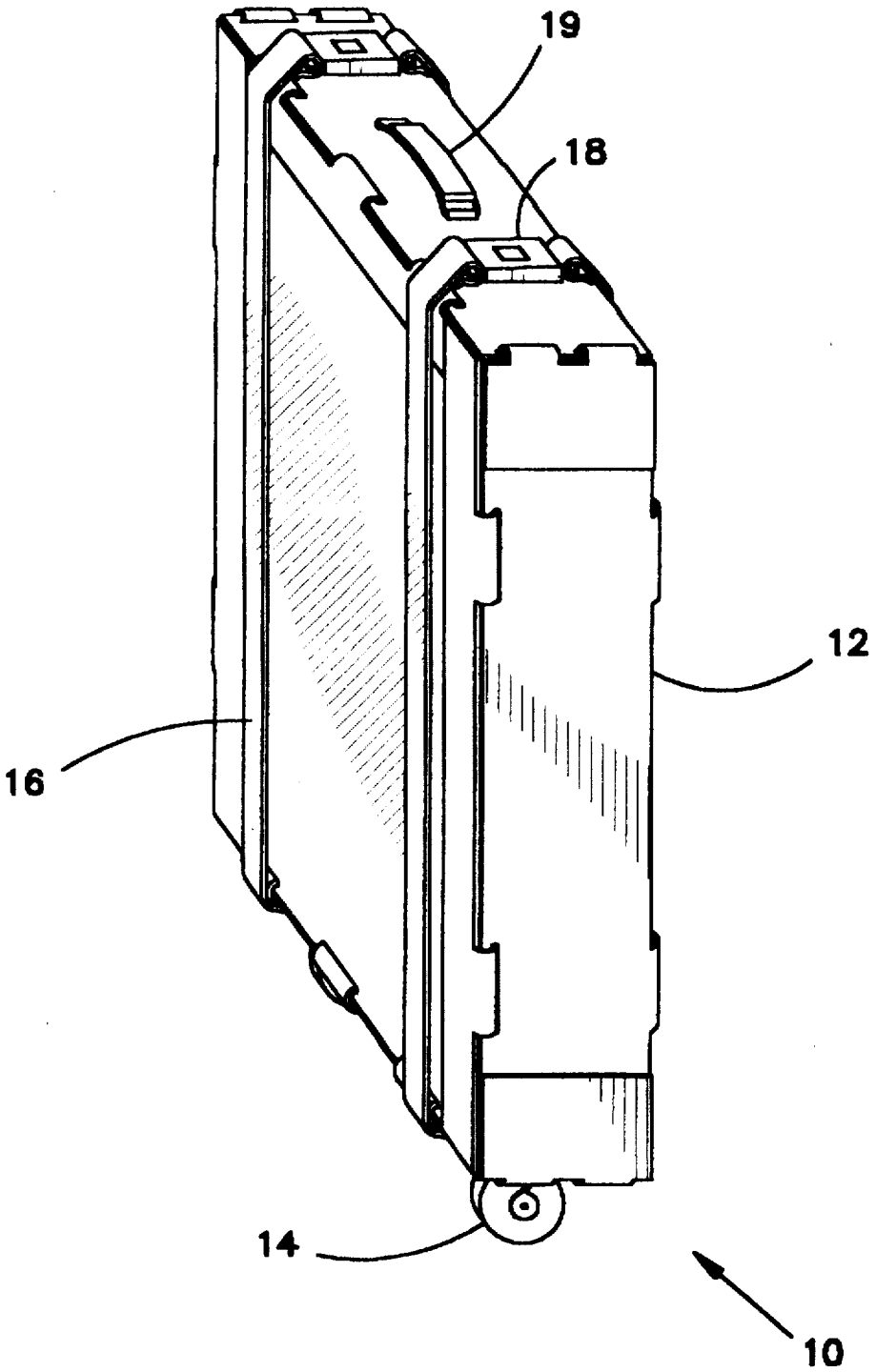
FIG. 8 is a diagrammatic perspective view of the suitcase, fully assembled.

FIG. 8 illustrates a suitcase 10, in a fully assembled state. The suitcase 10 has a suitcase shell 12, and a wheel assembly 14 attached thereto. The wheel assembly 14 is attached to the suitcase shell 12 with straps 16. Each strap 16 is held together with a buckle 18. The buckle 18 may be selectively opened and closed in a similar manner that a common automobile seat belt is secured and released. A handle 19 is provided on the suitcase shell 12, to allow easy handling of the suitcase 10.

Referring back to FIG. 2, the suitcase shell 12 is constructed of panels 20, including major panels 22 and strip panels 24. The panels 20 each have panel edges 21 at their periphery. The major panels 22 are six in number, representing the six sides of a rectangular prism. The panels 20 have overall sizes and shapes that allow them to form a rectangular prism which defines a storage space. The strip panels 24 affix between various major panels 22, to allow them to form a structurally sound rectangular prism, capable of withstanding internal and external stresses inherent in transporting a fully packed suitcase.

Figure 3:
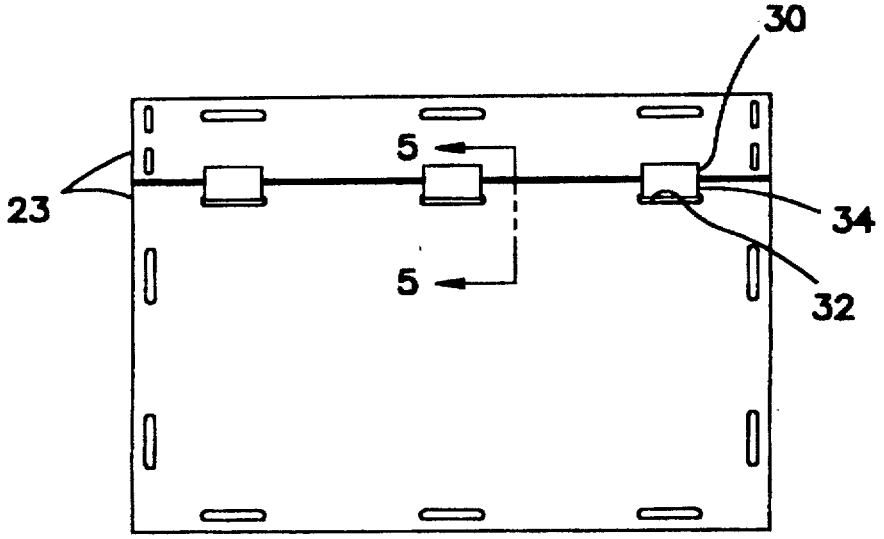
FIG. 3 is a top plan view, illustrating two panels joined together according to the present invention.
Figure 4:
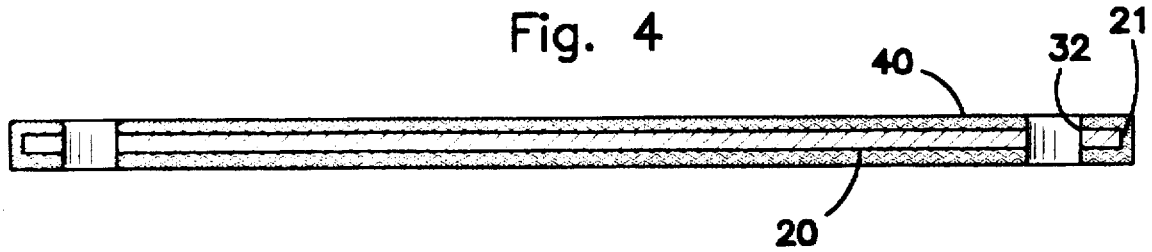
FIG. 4 is a cross sectional view, taken generally in the direction of line 4—4 in FIG. 2.
Figure 5:
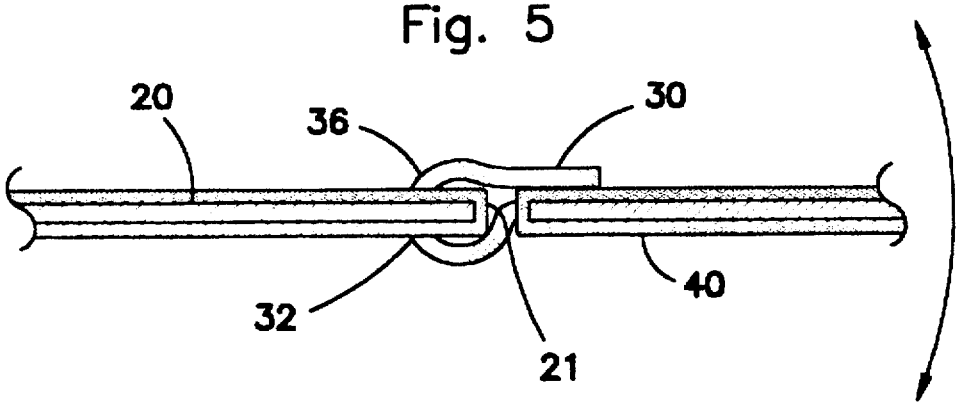
FIG. 5 is a cross sectional view, taken in the direction of line 5—5 in FIG. 3.

Generally, the major panels 22 each have tab extensions 30 and tab slots 32. Referring momentarily to FIG. 3, which shows two adjoining panels 23, the major panels 22 are joined together by a hinge assembly 34 which preferably comprises the tab extensions 30 and tab slots 32. Each tab extension 30 extends through one of the tab slots 32, and is bent to secure the tab extension 30 in the tab slot 32. Referring to FIG. 5, the tab extensions 30 form a loop 36 having a loop diameter. The loop 36 forms a bend in the tab extension 30, and brings the tab extension 30 through a one hundred eighty degree turn. Thus, a hinge is created, wherein the angle of the panel 20 having the tab slot 32 may be varied with respect to the panel 20 having the tab extension 30 nearly one hundred eighty degrees. Preferably, the tab slot 32 is close enough to the panel edge 21 to allow the panel 20 having the tab slot 32 to easily move within the loop 36. Thus, referring to FIG. 4, the distance between the tab slot 32 and panel edge 21 should be slightly less than the loop diameter. If the distance between the tab slot 32 and panel edge 21 is too large, then that area of the panel 20 will twist slightly when the panels 20 are folded with respect to each other.

Different arrangements may be employed for the hinge assembly 34. What is desired is to adjoin each panel with at least one distinct hinge assembly which adjoins separate panels. It is highly desirable to employ distinct panels, rather than use the "cake box" principal of using a continuous piece of material that is bent is various places to form a box. Such an arrangement is not durable, since the material will break at the bend points after several uses. Typically several hinge assemblies will be employed, which will share the job of holding adjoining panels together.

The panels 20 themselves are preferably made of sheet aluminum. Aluminum is lightweight, and thus thin sheets will have adequate strength, while providing for an easily storable suitcase. Ideally, referring to FIG. 4 and FIG. 5, the suitcase 10 will have a fabric covering 40. As illustrated, the fabric covering 40 individually covers each panel 20, while the tab extension 30 extends beyond the fabric covering 40. Thus, the tab extension 30 is allowed freedom of movement. However, in another embodiment, the fabric covering 40 might continuously cover the entire suitcase shell 12. In such an embodiment, allowances must be made to provide sufficient slack between adjoining panels 23 to allow the adjoining panels 23 to be moved 180 degrees with respect to each other. To keep the fabric covering 40 manageable, the fabric should be affixed to each panel 20 in its center portions, yet remain free or loose near the edges. Otherwise, the fabric covering 40 would have a tendency to "bunch up" when the panels 20 are folded for storage.

Referring back to FIG. 2, the major panels 22 include a bottom panel 51, a top panel 52, a rear panel 53, a front panel 54, and two side panels 55. The major panels 22 are arranged such that the two side panels 55, the rear panel 53 and the front panel 54 adjoin the bottom panel 51. The top panel 52 adjoins the rear panel 53. Between each pair of adjoining panels are several tab extensions 30 and tab slots 32 which mate to each other to form the hinge assemblies 34 which allow the panels 20 to be folded flat against each other in either direction.

In addition, a plurality of strip panels 24 are attached to the main panels 22 using the tab extension 30 and tab slot 32 arrangement. The strip panels 24 are then selectively attachable to another main panel 22 by means of fastening material 27 to form a structural bond between both said main panels 22. The strip panel 24 has fastening material 27 which mates to complementary fastening material on a surface to which the strip panel 24 is to be affixed. Preferably the fastening material 27 is hook and loop fastener material.

Figure 2:
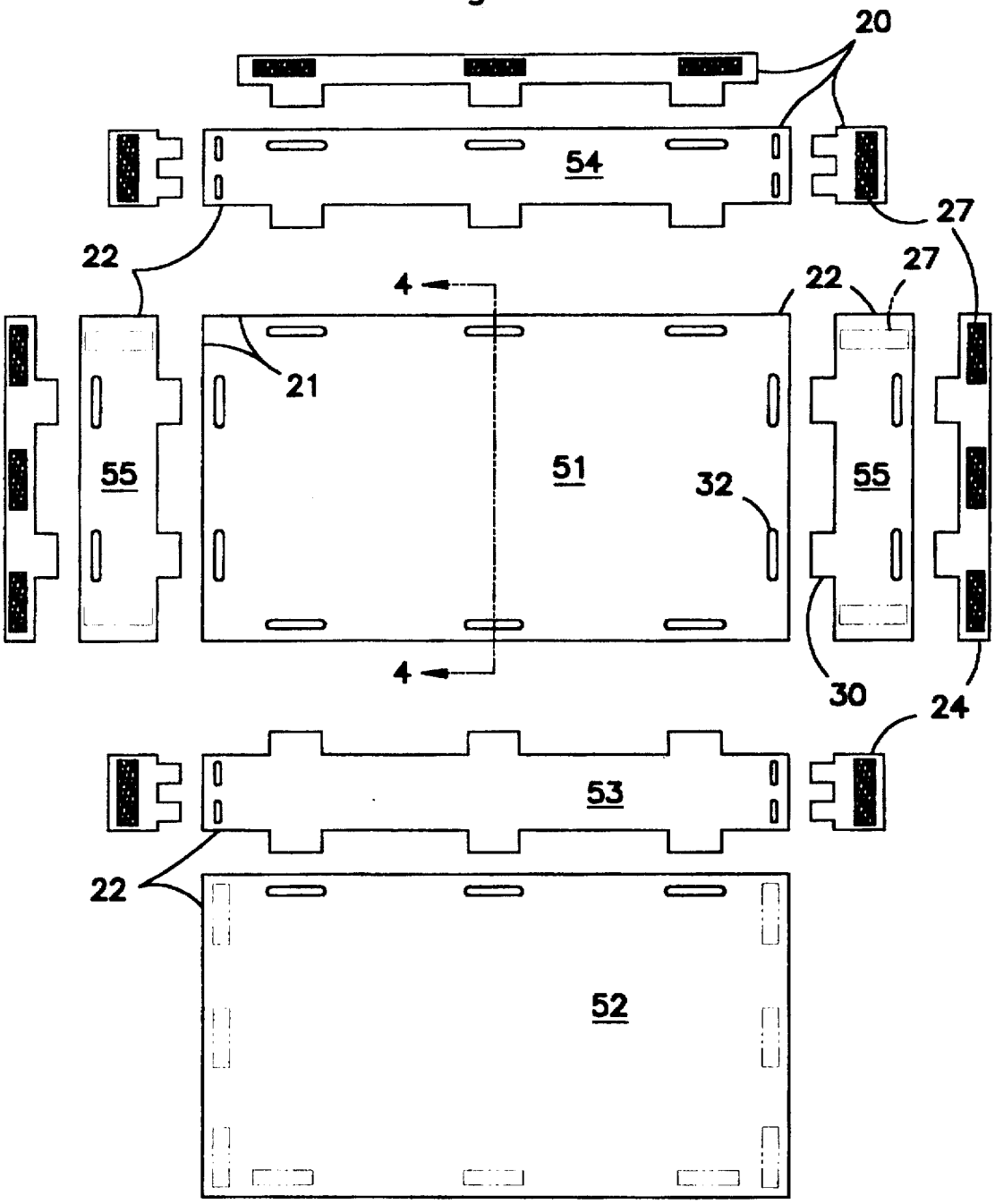
FIG. 2 is a top plan view, illustrating the various panels of the invention, detached from one another.

When the major panels 22 are expanded flat, as in FIG. 2, it can be seen that every edge of each of the major panel 22 either adjoins an adjacent panel, has a strip panel 24 attached thereto, or has fastening material 27 located near said edge. Thus, nonadjoining edges fasten to each other using a combination of the strip panel 24 and fastening material 27.

The top panel 52 has fastening material 27 near three edges 21, but only adjoins another major panel 22 on edge 21. Thus, the top panel 52 represents the "top" of the suitcase 10, and is the panel 20 that is closed last, after the suitcase 10 is packed. When the top panel 52 is closed, the fastening material 27 fixes the top panel 52 to three of the strip panels 24, said strip panels 24 separately also adjoin the front panel 54 and two side panels 55.

Figure 1A:
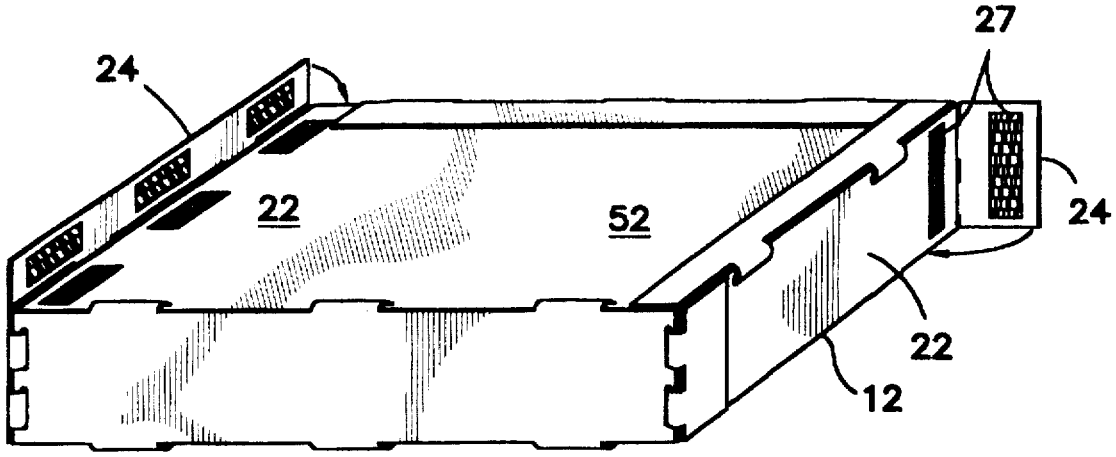
FIG. 1A is a diagrammatic perspective view of the invention being assembled.

Referring back to FIG. 1A, the major panels 22 have been folded with respect to each other such that the suitcase shell 12, in the shape of a rectangular prism is formed therewith. The strip panels 24, and associated fastener material 27, are being used to fully secure the major panels 22. The fastening material 27 holds the strip panels 24 onto the top panel 52 on at least three edges. Preferably, this final step of assembly is performed after the suitcase 10 is packed.

Figure 1B:
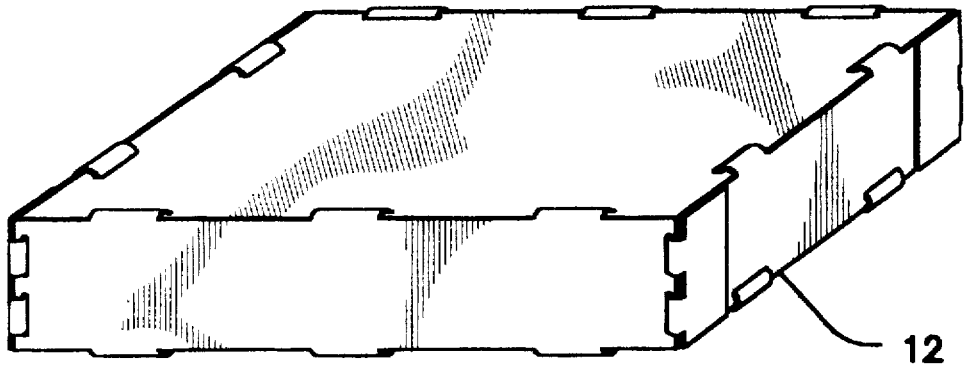
FIG. 1B is a diagrammatic perspective view of the invention, similar to FIG. 1A, but in a further state of assembly.

FIG. 1B is a bottom plan view of the assembled suitcase shell 12, illustrating all major panels 22 nearly perpendicular to one another.

Figure 6:
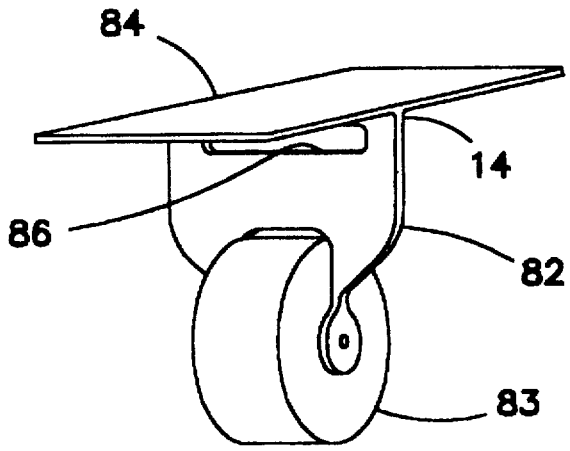
FIG. 6 is a diagrammatic perspective view of a wheel assembly, according to the present invention.

FIG. 6 illustrates a wheel assembly 14 for use according to the present invention. The wheel assembly 14 has a vertical support 82 to which a wheel 83 is attached, and a flange 84 extending perpendicular to the vertical support 82. The vertical support 82 has a strap slot 86 extending horizontally across the vertical support 82.

Figure 7:
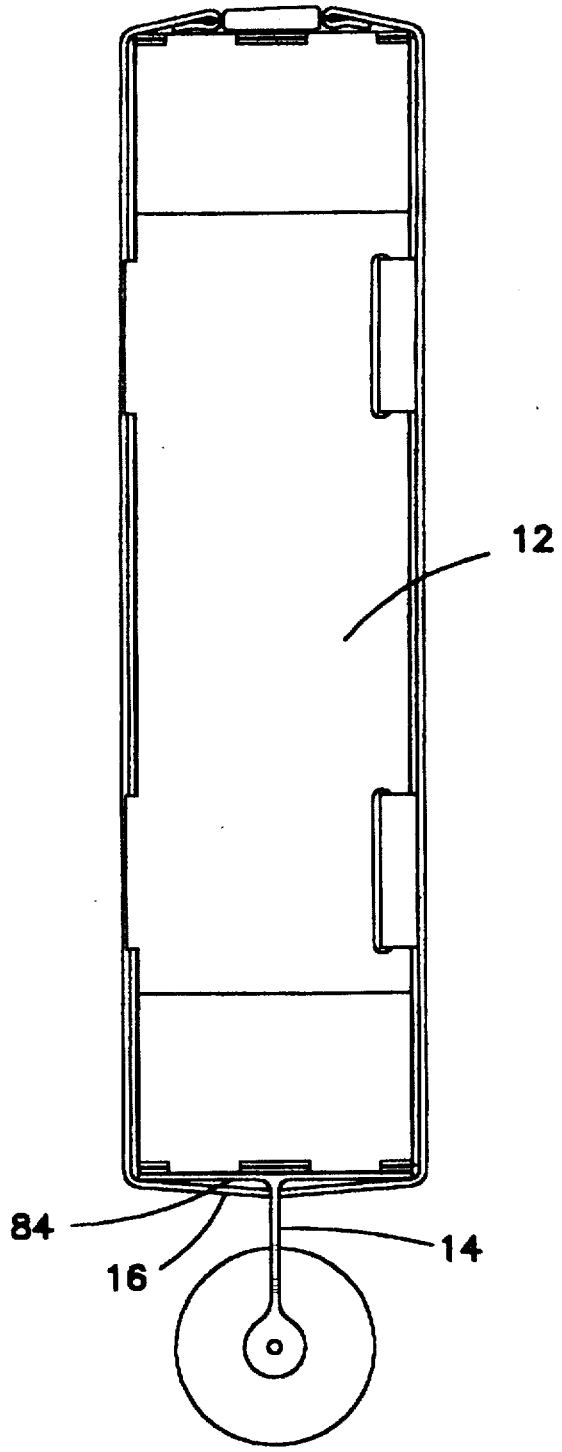
FIG. 7 is a side elevational view of the invention, with the wheel assembly attached.

Referring to FIG. 7, the wheel assembly 14 is attached to the suitcase shell 12 with the straps 16. The straps 16 extend through the strap slot 86 and pull tightly against the flange 84, holding the wheel assembly 14 firmly against the suitcase shell 12. The straps 16 are tensioned and held together with the buckle 18.

Referring once again to FIG. 8, the suitcase 10 is shown fully assembled. When the destination is reached, the buckles 18 are loosened, releasing the straps 16 and thus the wheel assemblies 14. The top panel 52 is then opened by releasing the strip panels 24 which hold it in place. The suitcase 10 may then be unpacked —removing belongings from the storage space defined by the suitcase shell 12. The fastening material 27 holding the remaining strip panels 24 is released to fully unfold the suitcase shell 12. The hinge assemblies 34 allow all adjoining panels to be folded against one another in either direction. Thus, the suitcase shell 12 may be compactly folded flat for storage, and then unfolded again when needed.

In conclusion, herein is presented a suitcase which is constructed of thin individual panels joined to each other by hinge mechanisms which allow the panels to selectively form right angles so that the panels form a rectangular prism defining a storage space. The panels are held together using fastener material, and buckled straps which also hold wheel assemblies onto the suitcase shell. After use, the straps and wheel assemblies are released, and the suitcase is folded flat for storage

What is claimed is:

1. A suitcase, comprising six major panels, said panels having edges, each of said panels adjoining at least one other major panel, the panels sized and shaped to selectively form a suitcase shell in the shape of a rectangular prism, defining a storage space; and hinge assemblies between adjoining panels, said hinge assemblies comprising a tab extension extending from one of the adjoining major panels and a tab slot in the other adjoining panel, said tab extension extends into said tab slot and then forms a substantially one hundred eighty degree loop.

2. The suitcase as recited in claim 1, further comprising at least one strip panel, said strip panel adjoining one of the major panels, said strip panel hinged to said major panel, said strip panel having fastener material which attaches said strip panel to another major panel.

3. The suitcase as recited in claim 2, wherein said major panels are made of sheet aluminum.

4. The suitcase as recited in claim 3, wherein each loop has a loop diameter, wherein each tab extension extends from one of the edges of one of the major panels, wherein each tab slot is located near one of the edges of one of the major panels, and wherein the distance between each tab slot and its associated edge is less than the loop diameter.

5. The suitcase as recited in claim 4, wherein:

the major panels comprise a top panel, a bottom panel, a front panel, a rear panel, and two side panels;

said bottom panel adjoins said front panel, said rear panel, and said side panels; and said top panel adjoins said rear panel.

6. The suitcase as recited in claim 5, wherein each edge of each major panel has one of:

an adjoining major panel at that edge;

a strip panel attached to that edge; and fastening material attached near that edge.

7. The suitcase as recited in claim 6, further comprising wheel assemblies, and straps, said wheel assemblies attaching to said suitcase shell with said straps.

8. The suitcase as recited in claim 7, wherein each of said straps have a buckle for tensioning the strap and the wheel assembly against the suitcase shell and providing structural support for said suitcase shell.

9. The suitcase as recited in claim 8, wherein said wheel assembly comprises a vertical support, a wheel mounted to said vertical support, a flange, and a strap slot in said vertical support, the strap extending through the strap slot, said flange held tightly against the suitcase shell by the strap.

10. The suitcase as recited in claim 9, wherein top panel has fastener material near three of its edges, and three strip panels secure to said top panel.

* * * * *